US010677025B2

(12) United States Patent
Al-Gouhi

(10) Patent No.: US 10,677,025 B2
(45) Date of Patent: Jun. 9, 2020

(54) APPARATUS AND METHOD EMPLOYING RETRIEVABLE LANDING BASE WITH GUIDE FOR SAME LOCATION MULTIPLE PERFORATING GUN FIRINGS

(71) Applicant: Saudi Arabian Oil Company, Dhahran (SA)

(72) Inventor: Alwaleed A. Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 40 days.

(21) Appl. No.: 15/707,629

(22) Filed: Sep. 18, 2017

(65) Prior Publication Data

US 2019/0085665 A1 Mar. 21, 2019

(51) Int. Cl.

| | |
|---|---|
| ***E21B 43/11*** | (2006.01) |
| ***E21B 43/117*** | (2006.01) |
| ***E21B 43/1185*** | (2006.01) |
| ***E21B 43/119*** | (2006.01) |
| *E21B 47/024* | (2006.01) |

(52) U.S. Cl.

CPC ..... *E21B 43/117* (2013.01); *E21B 43/119* (2013.01); *E21B 43/11855* (2013.01); *E21B 47/024* (2013.01)

(58) Field of Classification Search

CPC ..... E21B 43/117; E21B 43/11855; E21B 43/119; E21B 43/116; E21B 47/024

See application file for complete search history.

(56) References Cited

U.S. PATENT DOCUMENTS 2,653,007 A 9/1953 Aston
2,679,898 A 6/1954 Forsyth et al.
(Continued)

FOREIGN PATENT DOCUMENTS

EP 0256178 A1 2/1988

OTHER PUBLICATIONS

Non-Patent Literature Document 1.
Non-Patent Literature Document 2.

*Primary Examiner* — Robert E Fuller
*Assistant Examiner* — Christopher J Sebesta
(74) *Attorney, Agent, or Firm* — Abelman, Frayne & Schwab

(57) ABSTRACT

Methods and apparatus are provided for conducting multiple successive same-location firings of a number of shaped charges carried by a perforating gun that is lowered into the wellbore and precisely positioned by engagement with a landing base assembly that includes a through-tubing retrievable bridge plug to which is secured a receiving member that matingly engages a perforating gun assembly that includes a mating guide member secured to the downhole end of the perforating gun and a rotating head member attached to the opposite upper end of the gun, the rotating head member configured for attachment to the downhole end of a length of coiled tubing for lowering the gun assembly and permitting its axial rotation and downward vertical movement into a final secure, but releasably engaged position with the fixed landing base assembly. The landing base assembly can be recovered via the production tubing using a wire line or coiled tubing following the multiple reservoir penetration firings by retraction of the locking anus of the bridge plug to their original collapsed position.

11 Claims, 8 Drawing Sheets

(56) References Cited

U.S. PATENT DOCUMENTS 3,307,642 A 3/1967 Smith
3,414,071 A 12/1968 Alberts
3,653,435 A 4/1972 Reistle et al.
4,410,051 A * 10/1983 Daniel ..... E21B 43/119 166/55.1
4,605,074 A * 8/1986 Barfield ..... E21B 34/063 166/297
4,619,333 A 10/1986 George
5,329,998 A * 7/1994 King ..... E21B 43/045 166/278
5,353,873 A 10/1994 Cooke, Jr.
5,865,252 A 2/1999 Van Petegem et al.
5,890,539 A 4/1999 Huber et al.
6,298,915 B1 * 10/2001 George ..... E21B 43/119 166/255.2
6,394,184 B2 5/2002 Tolman et al.
6,776,239 B2 8/2004 Eslinger et al.
7,172,023 B2 2/2007 Barker et al.
7,303,017 B2 10/2007 Barker et al.
7,913,603 B2 3/2011 LaGrange et al.
7,980,309 B2 7/2011 Crawford
8,079,296 B2 12/2011 Barton et al.
9,506,330 B2 11/2016 Al-Gouhi
2004/0216632 A1 11/2004 Finsterwald
2005/0194181 A1 9/2005 Barker et al.
2006/0243443 A1 11/2006 Matthews
2008/0128132 A1 * 6/2008 Wilcox ..... E21B 43/116 166/281
2009/0288879 A1 * 11/2009 Arena ..... E21B 23/02 175/4.51
2015/0027695 A1 * 1/2015 Mitchell ..... E21B 43/119 166/255.1
2015/0083440 A1 * 3/2015 Andersen ..... E21B 34/14 166/387
2015/0226044 A1 * 8/2015 Ursi ..... E21B 43/119 166/55
2016/0108708 A1 * 4/2016 Al-Gouhi ..... E21B 43/117 175/4.51
2016/0160620 A1 6/2016 Al-Gouhi
2017/0167235 A1 * 6/2017 de Jong ..... E21B 43/119

* cited by examiner

APPARATUS AND METHOD EMPLOYING RETRIEVABLE LANDING BASE WITH GUIDE FOR SAME LOCATION MULTIPLE PERFORATING GUN FIRINGS

FIELD OF THE INVENTION

This invention relates to the use of perforating guns, that can be positioned without the use of a surface rig for multiple same location perforations of tight reservoir formations, e.g., deep penetrations in preparation for the hydraulic fracturing of the formation.

BACKGROUND OF THE INVENTION

Tight gas formations, such as Khuff carbonate, pre-Khuff sandstone and shale gas formations with high compressive strength require hydraulic fracturing procedures in order to open the reservoir formation and enhance the flow of gas to the well bore for production. In such tight gas-containing reservoir formations, a perforating gun is used to initiate formation breakdown by detonating high-performance deep-penetrating shaped charges that maximize perforation length and entry hole size to start the hydraulic fracturing or "hydrofracking", in order to enhance hydrocarbon production and optimize well flow.

The tubing-conveyed perforating (TCP) gun employs a drilling rig at the surface in operation to handle the tubing that conveys the gun to the desired depth in the well bore.

Perforating guns are available in various configurations. In each case, the key objective of the selection of the gun and the size, nature and set up of the shaped charges is to create a predetermined pattern of perforations over a predetermined wellbore interval.

The creation of deep perforations with large diameters has been addressed with varying degrees of success. To create deep perforations that bypass damaged zones, the perforation diameter should be small and the force of the shaped charge narrowly focused.

A method and apparatus are disclosed in U.S. Ser. No. 14/959,942 (US 2016/0108708) for multiple same location firings of a perforating gun to extend the depth of the initial lateral penetrations further into the surrounding formation. A latching tool and tubing-conveyed perforating (TCP) gun are lowered into the wellbore by a surface rig and engage a latch coupling that was previously secured to a section of a well casing proximate the predetermined interval in the wellbore that is to be penetrated to provide a fixed reference point. Withdrawal after the first firing and recharging of the gun, followed by its return and engagement of the latching tool with the latch coupling permits the perforation of the formation repeatedly and at the same position. The prepositioned latch coupling and releasably secured engagement of the latching tool provide a consistent, reproducible reference point at the predetermined depth and orientation for repeated use of the TCP gun in vertical and lateral wells.

An advance in the art is disclosed in published application US 2016/0160620 where the latch coupling is secured to the end of the production tubing which permits the assembly to be deployed downhole without the use of a surface rig, thereby reducing the overall costs associated with the penetration operation. The end of the tubing with the latch coupling, which serves as the gun anchoring point, are landed so that the latch coupling is proximate the perforation interval. However, if the perforation plan for the well is changed so that a perforation is to be performed at a lower depth, or further into a lateral/horizontal open hole wellbore, the accuracy at the new depth of a perforation at the same point will be jeopardized.

Current perforation practices can fail to provide a deep and large diameter penetration when the target zone is behind more than one casing. A problem also exists in formations with high compressive strength and can also fail to bypass formation damage caused by the explosive forces.

A problem to be solved then is to provide apparatus, systems and methods in preparation for hydraulic fracturing operations that operate without a rig for securely positioning a perforating gun at the desired location for the first of a planned series of firings and returning the gun after reloading at the surface to the same position and radial orientation for one or more firings to complete a plurality of reservoir perforations or penetrations to the same position in order to produce a deep penetration having a larger diameter than is currently possible.

The problem can also be stated as how to position and to subsequently return the perforating gun to the same location for successive or repeated reservoir penetration shots in wells, preferably operating without the use of a rig, i.e., perforating guns that are deployed by wireline and/or a coiled tubing unit, and also withdrawing all of the components after the penetration has been completed.

An additional problem to be addressed is maintaining the accuracy of the perforation when the perforation plan includes at least an additional perforation interval at a position in the wellbore that is displaced, e.g., beyond, the first perforation interval.

As used herein, the term "downhole" refers to both vertical and lateral wellbores. The figures illustrate vertical well orientations for convenience, and it will be understood that references to "above" and "below" are relative to the apparatus regardless of the orientation of the wellbore.

For convenience, the following describes the installation and use in a well lined with a casing, but as will be understood by one of ordinary skill in the art, the method is equally applicable to perforating an interval in an open hole wellbore.

SUMMARY OF THE INVENTION

The above problems are resolved and other benefits and advantages are achieved by the use of the landing base assembly and perforating gun assembly of the present disclosure. The landing base assembly includes a through-tubing retrievable bridge plug and receiving member that is secured in axial alignment to the top or upper end of the bridge plug.

The perforating gun assembly includes a guide member that is dimensioned and configured to mate with the receiving member of the landing base assembly. The guide member is secured to the perforating gun in axial alignment with its longitudinal axis. A rotating head member is secured in axial alignment to the top or upper end of the perforating gun. The perforating gun remains attached by the rotating head to the coiled tubing when the gun assembly is downhole and is only released from the end of the coiled tubing at the surface in order to remove a gun that has been fired and load another gun with the same charge configuration. After securing a loaded gun to the coiled tubing, the gun assembly is lowered into engagement with the receiving member. The rotating head member permits relative rotational movement of the perforating gun and attached guide member, as will be described in more detail below, in order to facilitate the mating of the landing base assembly and the perforating gun assembly in preparation for firing.

The top or end of the rotating head member opposite the gun is secured to a stationary locking device that is provided with a releasable attachment fitting adapted to matingly engage with a cooperating fitting on the downhole end of the length of coiled tubing or other intermediate component. Such releasable fittings are known in the art.

As will be described in greater detail below, in one aspect. This disclosure broadly comprehends a method and apparatus in which a stationary receiving member is dimensioned and configured to receive a guide member that is attached directly or indirectly, to the downhole end of a perforating gun, whereby the two members enter into a secure mating engagement by their relative rotating movement until the advancement of the downhole end of the guide member is arrested by contact with the interior surface of the bottom of the stationary receiving member. The rotational movement is defined by a spiral path. The descent of the guide member into the receiving member is the result of gravitational force applied to the perforating gun assembly, which assembly optionally includes additional mass to overcome frictional forces created by well contaminants contacting the sliding surfaces of the respective members. This additional mass is provided, for example, by a supplemental weight member that is secured to comprise an element of the perforating gun assembly and in axial alignment with the perforating gun in order to maximize the downward gravitational force vector.

In an embodiment suitable for the practice of the invention, the apparatus is assembled and put into position for use in accordance with the following stepwise procedure:

1. A suitable bridge plug of a size and configuration adapted to securely engage the interior walls of a section of well liner or casing below the interval that is to be penetrated by the perforating gun is securely fastened in axial alignment to the base of the receiving member. As will be apparent to those of ordinary skill in the art, the size of the bridge plug selected will be based on the interior diameter of the well liner, e.g., a 7-inch or 4.5-inch liner, or of the wellbore itself in the case where the perforation interval is located in an open hole. A wireline or the end of a length of coiled tubing is attached by appropriate means well known in the art. The receiving member has an inside diameter that is sufficient to permit a conventional bridge plug setting and actuating tool to be connected directly to the bridge plug. The landing base assembly is lowered downhole through the production tubing. When the retrievable bridge plug has reached the predetermined depth proximate to, and below the reservoir interval that is to be penetrated, the bridge plug is actuated and the arms are extended to engage the interior wall, e.g., of the adjacent well liner or casing, thereby securing the bridge plug in a fixed and stable position in the wellbore. At the same time, the central seal portion of the bridge plug is expanded until it engages the wall of the liner or casing, thereby forming a fluid-tight seal. The wireline tool or coiled tubing is disengaged from the attachment point and withdrawn from the wellbore via the production tubing. The female profile of the gun guide receiving member on top of the retrievable bridge plug has an inside diameter that is sufficient to permit the bridge plug setting/releasing tool to be connected directly to the bridge plug.

2. The perforating gun is fitted with the desired number and size of shaped charges in accordance with instructions provided by the well engineer. The guide member is secured to the downhole end of the perforating gun and the rotating head member is secured to the top or upper end of the perforating gun opposite the guide member. A stationary locking device is secured to the rotating head member which has one or more conventional releasable attachment fittings on its upper surface for engagement with a mating fitting on the downhole end of the wire line or coiled tubing, or other intermediate component, such as a supplemental weight member as described below. As will be understood by one of ordinary skill in the art, both the landing base assembly and the perforating gun assembly are most conveniently assembled in a shop or other remote location and multiple assemblies can be stocked for eventual delivery to the well site where they are fitted with the prescribed number and size of shaped charges for use in the penetration of the reservoir.

3. The perforation gun assembly is secured to the end of a length of coiled tubing or wire line that is sufficient to lower the gun assembly into mating engagement with the landing base assembly. It will be understood by those familiar with the art that the interval to be penetrated is known to span a predetermined vertical depth range and that the positioning of the landing base assembly can be done with sufficient precision to permit the perforating gun assembly to be put into the desired predetermined position in the wellbore to perforate the surrounding casing and provide repeated firings through the casing openings to penetrate the surrounding hydrocarbon-containing zone that is to be subjected to hydrofracturing.

4. The perforating gun assembly can be lowered rapidly through the production tubing until it has reached a predetermined depth approaching the known depth of the landing base assembly, after which it is lowered more slowly. When the guide member makes initial contact with the upper end of the receiving member, it is directed into mating relation with the receiving member. In an embodiment, a radially projecting pin enters a corresponding spiral channel or groove in the adjacent member and by virtue of the force provided by a supplemental weight, the guide member advances into the receiving member and rotates clockwise as the projecting pin moves along the spiral groove of the receiving member, moving along the longitudinal axis of the members until it reaches the end of the spiral groove. At the same time, the rotating head makes a predetermined number of rotations based on the distance of the downward by advancing movement until it reaches the end of the spiral groove, at which point the rotating head locks the system beneath it into position. In an alternative embodiment, the downhole end of the gun assembly is provided with an external grooved guide member having a spiral profile or configuration that engages a corresponding internal spiral groove, thereby producing a rotational movement of the gun assembly, until the gun assembly locks into its final desired position.

5. After the secure mating engagement of the gun assembly with the landing base assembly, the perforating gun shaped charges are fired using conventional control means that are located at the wellhead.

6. Following the first firing, the perforating gun assembly is released from the receiving member by applying a predetermined over pull force to unlock the rotating head, after which the head rotates counter-clockwise as the guide retraces its path to disengage the guide from the receiving member. The perforating gun assembly is withdrawn via the production tube to the surface where it is reloaded or replaced with a fresh loaded gun and lowered again as described above.

7. This procedure can be repeated for as many firings as the well engineer has determined are necessary to achieve the desired depth and diameter of the reservoir penetration.

That is, a third or subsequent charge(s) can be fired following this procedure which provides for accurate same-location penetrations, even though the gun is withdrawn from its downhole position for reloading and then repositioned downhole.

8. Following the final firing of the perforating gun, the gun assembly is withdrawn through the production tubing by the coiled tubing. As will be understood by one of ordinary skill in the art, a wireline or coiled tubing secured to a bridge plug retrieving tool is lowered into the well via the production tubing. The retrieving tool will pass through the central opening of the receiving member that is positioned above the plug and engages the plug in the conventional manner to effect its release as is known to the prior art. The landing base assembly is then retrieved via the production tubing and removed from the well at the surface. As will be understood from the above, following the final firing, both the perforation gun assembly and the landing base assembly apparatus are withdrawn from downhole and nothing remains to interfere with subsequent operations.

From the preceding description it will also be understood that the landing base assembly provides the assurance of a secure fixed position for the repeated engagement of the receiving member with the guide member, and that the gun to which it is attached will assume the same axial orientation when it is repeatedly lowered into its final position for successive firings. The depth of the gun is consistently the same because it comes to rest, or lands, on the landing assembly, the position of which is fixed by the secure engagement of the expanded bridge with the casing wall below the interval that is to be penetrated by the perforating gun charges. After the first and subsequent firings of the gun, the gun assembly is retrieved to the surface for replacement or reloading or, after the final firing, for permanent removal from the well along with the entire landing base assembly, leaving no components behind.

It will also be understood that the new landing base assembly of the present disclosure functions to by-pass the near-wellbore damaged zone and can provide better penetration of more than one casing by same location repeated reservoir penetrations when the well is not equipped with the latch coupling system, such as is described in U.S. Pat. No. 9,506,330, "System and Method Employing Perforating Gun for Same Location Multiple Reservoir Penetrations".

BRIEF DESCRIPTION OF THE DRAWINGS

The invention will be described in more detail below and with reference to the attached figures in which the same or similar elements have the same number, and where.

DETAILED DESCRIPTION OF INVENTION

Figure 1:
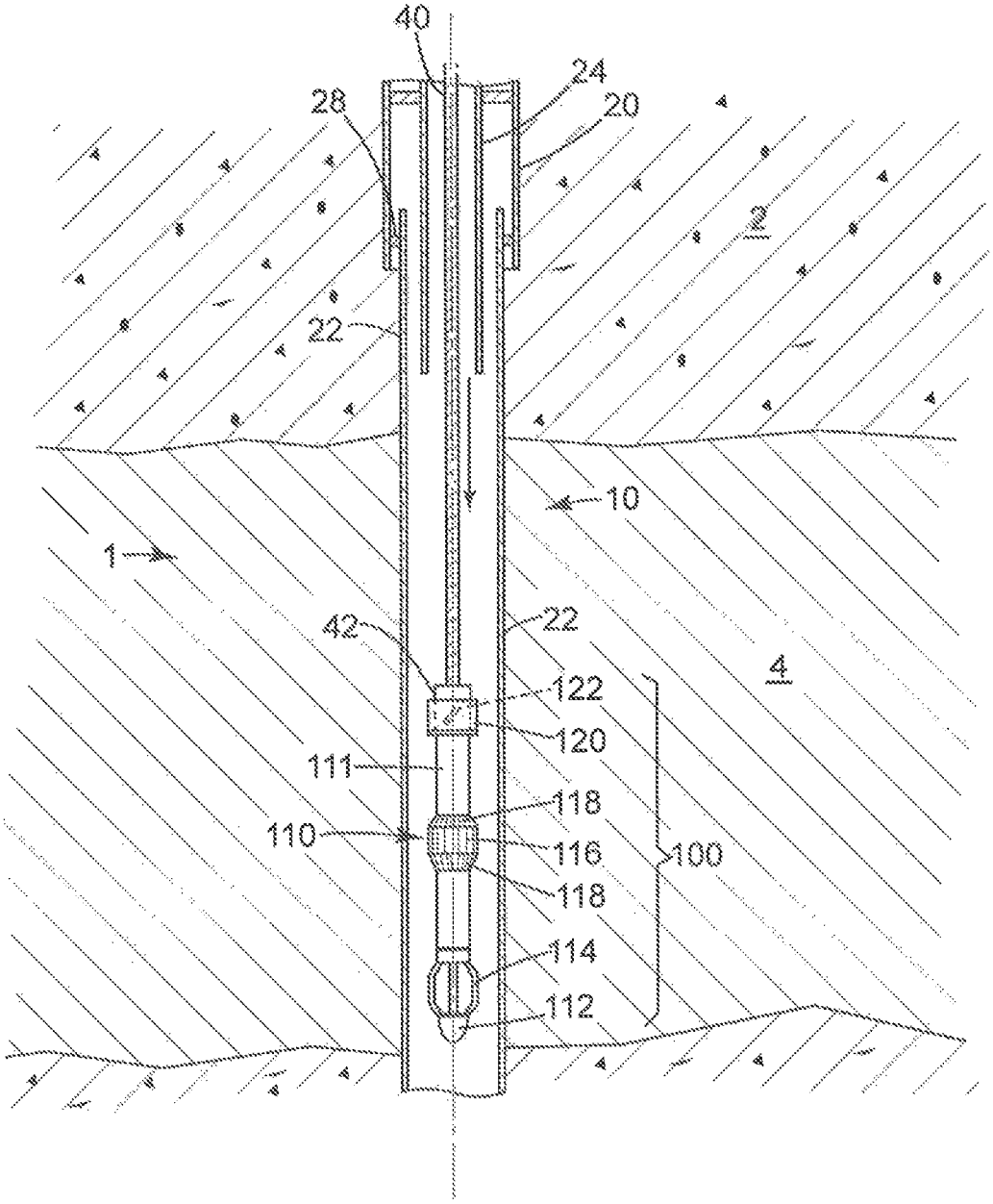
FIG. 1 is a simplified schematic illustration of a landing base assembly of the present disclosure prior to its actuation shown suspended below the production tubing adjacent a section of well casing in a wellbore in a tight reservoir formation.

Referring now to the schematic illustration of FIG. 1, there is shown a downhole portion 1 of wellbore 10 in a section of reservoir rock 2 in a tight formation in which hydraulic fracturing is required to enhance gas production. It is to be understood that the region 2 above the hydrocarbon containing interval of reservoir rock 4 in a tight formation can extend for thousands of feet from the earth's surface before reaching the interval at which hydrofracking is required. As shown in FIG. 1, the final section of well liner 22 is secured in position by packers 28 at the end of well casing 20. Liner 22 extends beyond the end of the production tubing 24 and terminates below the hydrocarbon containing interval 4. As also shown in FIG. 1, production tubing 24 terminates in the well liner above the interval to be perforated.

Figure 2:
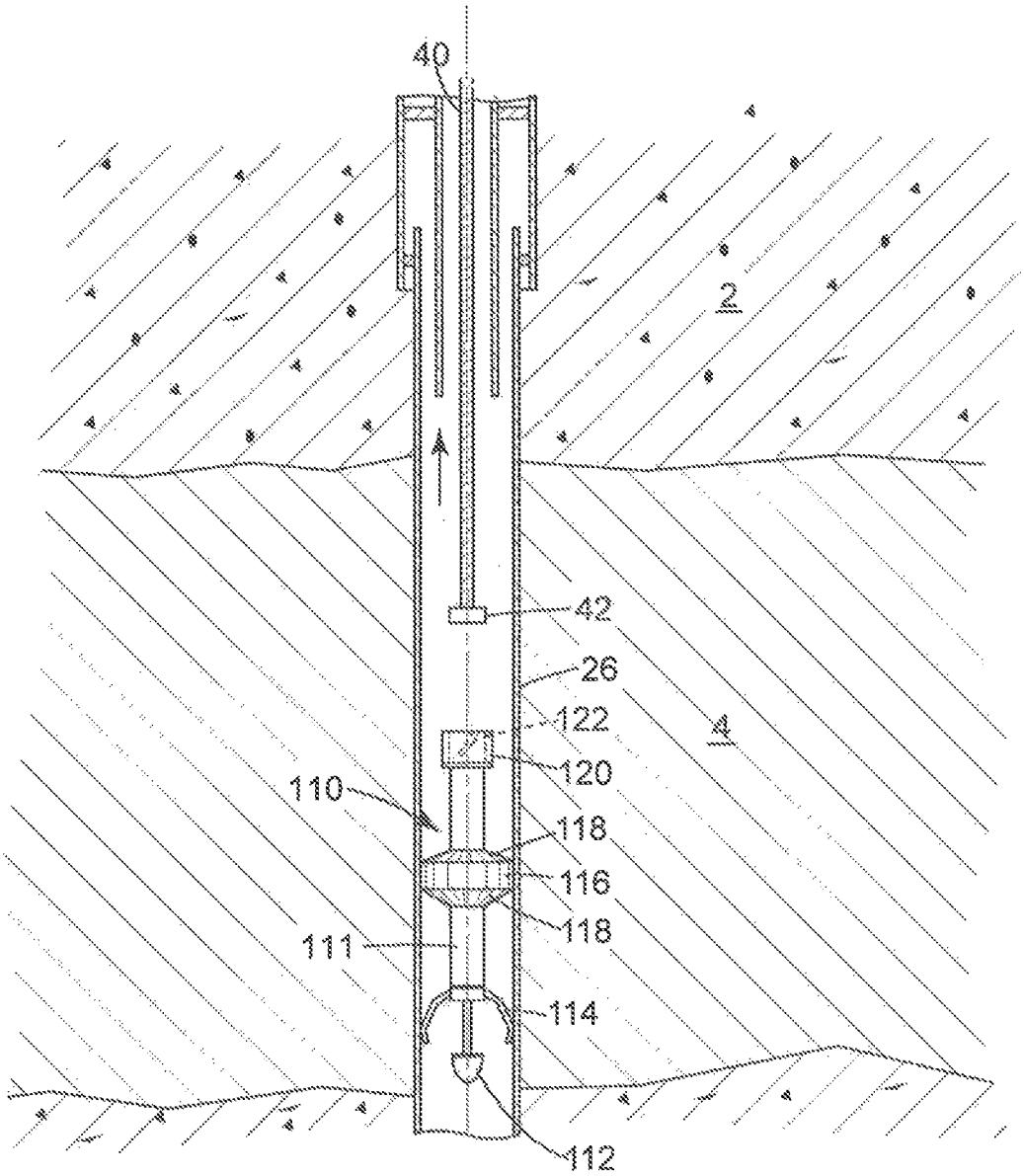
FIG. 2 is a schematic illustration of the landing base assembly shown in FIG. 1 following actuation to open the bridge plug and secure it in position by engagement of the bridge plug arms and seal with the well casing.

With continuing reference to FIG. 1, a through-tubing retrievable bridge plug 110 is shown suspended in the region below, but proximate to the interval that is to be perforated. A receiving member 120 is secured to the top or upper end of bridge plug 110 to constitute the landing base assembly 100. The receiving member is fitted with a latch mechanism 122 that is adapted to releasably engaged with a connecting member 42 attached to the end of a length of coiled tubing 40 extending to the surface or, alternatively, to a wireline or other similar device (not shown) for lowering the landing base assembly 100 into position in the wellbore. As will be understood by one of ordinary skill in the art, the retrievable bridge plug 110 is of an elongated configuration and dimensioned so that will pass through the production tubing 24. The bridge plug includes a known mechanism for expanding the polymeric central portion 116 to form a seal with the well liner by movement of the adjacent expansion members 118. In addition, sidewall engagement legs 114 extend outwardly and are provided with machined or sharply ridged surfaces that engage and a securely grip the surrounding walls of the liner 22 to further stabilize the unit and maintain it in a fixed position at the desired location. As illustrated in FIG. 2A, the bridge plug has assumed the expanded fixed position and the coiled tubing 40 is disengaged from the latching mechanism 122 on the guide member 120 and has been retracted to the surface.

Figure 3:
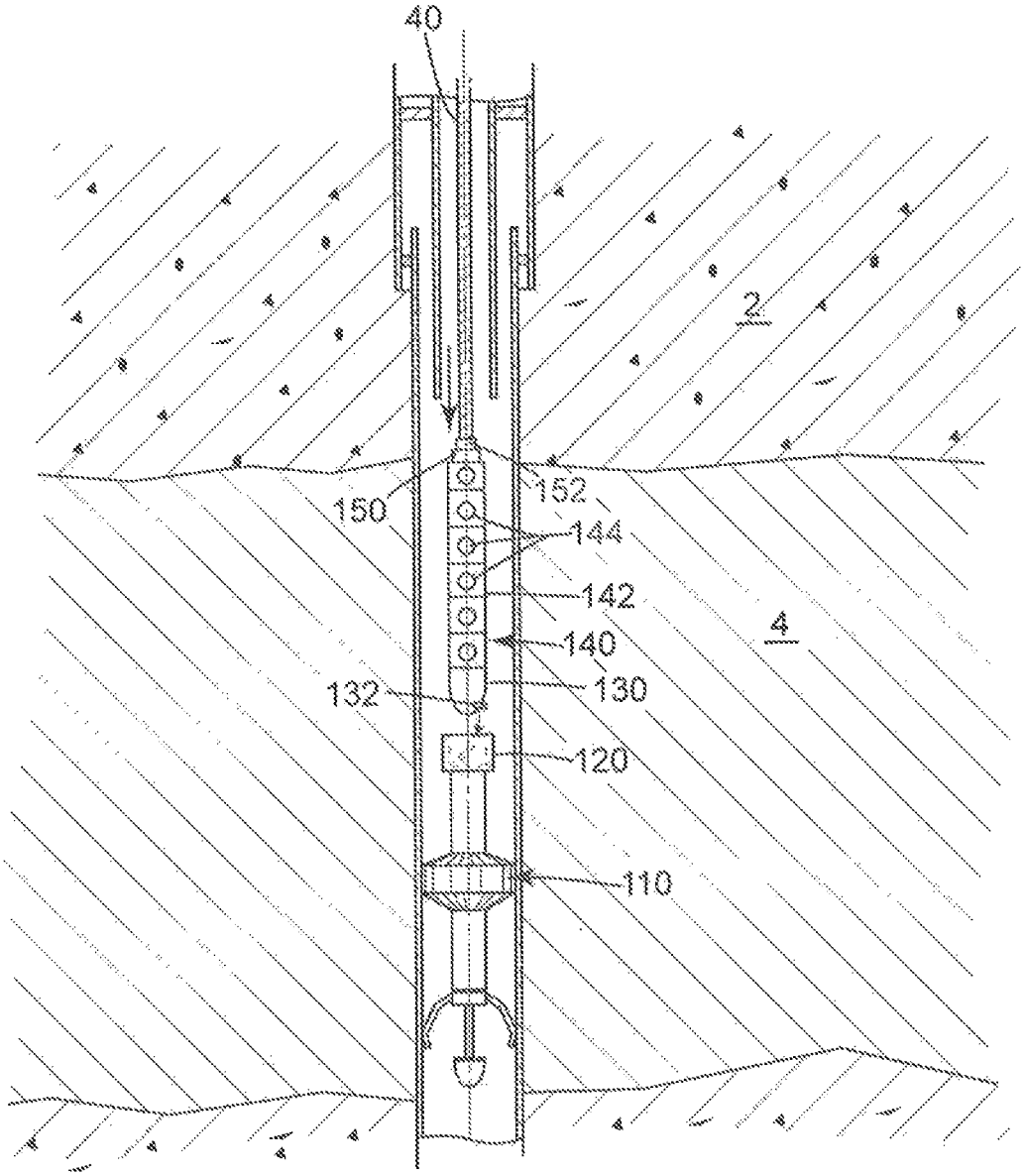
FIG. 3 is a simplified schematic illustration of a perforating gun assembly in accordance with the invention being lowered to position for engagement with the landing base assembly.

With reference to FIG. 3, the landing base assembly 100 is shown in position in the lower section of the liner 26 and the perforating gun assembly 200 is shown being lowered via coiled tubing 40 to a position above the landing base assembly. The perforating gun assembly 200 includes guide member 130 attached to the downhole end of perforating gun 140 and rotating head 150 secured to the top or upper end of perforating gun 140. The upper portion of the rotating head member is capable of axial rotation with respect to the lower portion and is secured by latch mechanism 152 to the releasable connector 42 at the end of coiled tubing 40. As illustrated, the perforating gun 140 includes gun body 142 with appropriate receptacles for receiving a plurality of longitudinally and axially spaced shaped charges 144. The size and configuration of the shaped charges are selected in accordance with the well design engineer's specifications for the particular penetrations desired. The charges typically are fired in a direction that is normal to the longitudinal axis of the gun body.

As will be described in more detail below, the receiving member 120 is dimensioned and configured to mate with the guide member 130 of the perforating gun assembly 200 in a rotational locking engagement. As the two members are brought into contact and vertical alignment, one passes into the other. In an embodiment, the receiving member 120 comprises a hollow or annular body having a descending spiral channel 122 formed in its interior side wall. The guide member 130 at the downhole end of gun assembly 200 is dimensioned to enter the annular portion of the receiving member and has a radially projecting guide pin 132 extending from its exterior surface that engages the guide channel 122. This permits the perforating gun assembly 200 to descend vertically with a rotational motion that is permitted by the rotating head member 150 until the guide member assumes a locked position in the interior of the receiving member. This specific configuration of the receiving member 120 and guide member 130 are described in more detail below and in various embodiments. The receiving member 120 is also provided with one or more fluid discharge ports 124 to allow trapped fluids and any settled solids to be ejected from the interior of its hollow body when the guide member 130 enters.

Figure 4:
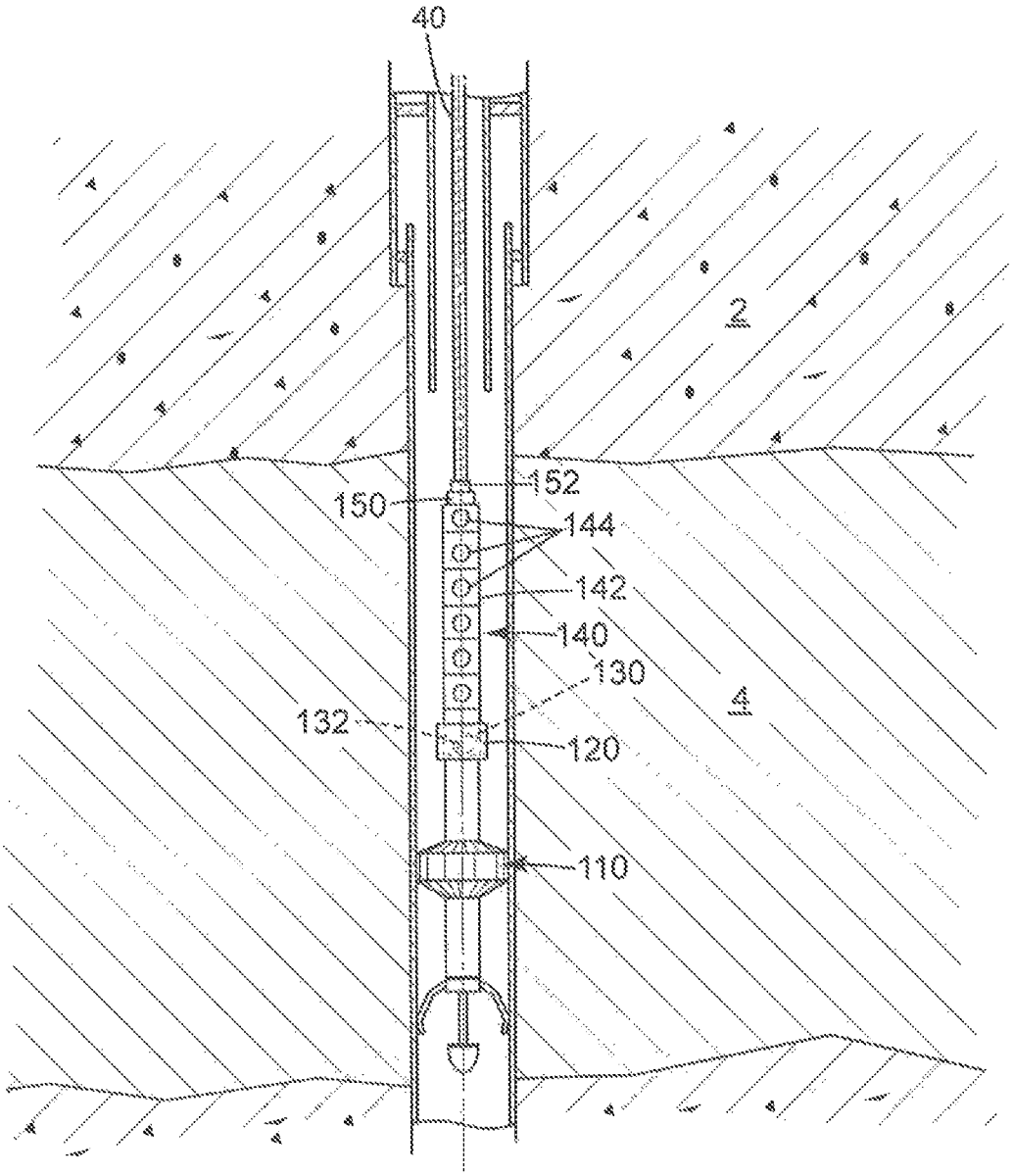
FIG. 4 is a schematic illustration, partly in section, of the perforating gun assembly in an engaged and releasably locked position with the landing base assembly.

The two assemblies are shown in a fully engaged position in FIG. 4. The perforating gun is now ready to be fired on receipt of the signal from the control station at the surface.

After the firing of the gun 140, a sufficient pulling force, or over pull, is exerted on the coiled tubing 40 to overcome the gravitational and initial frictional forces on the sliding surfaces of the groove and pin and to rotate the guide member as the projecting guide pin 132 moves upwardly through the spiral groove 122 in order to disengage the guide member from the receiving member which is retained by the expanded bridge plug 110 in its original secured stationary position with the landing base assembly 100.

Figure 5:
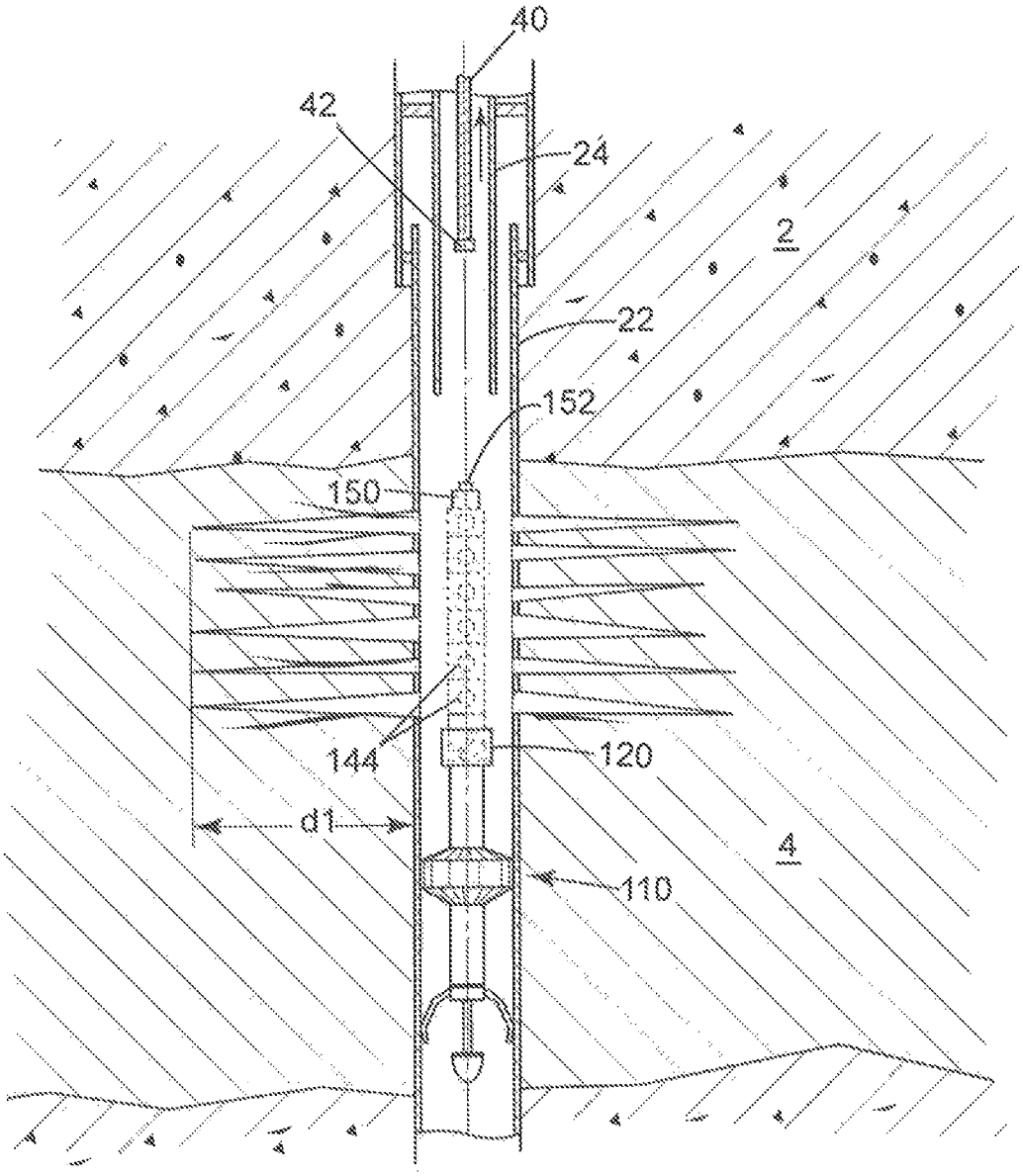
FIG. 5 is a schematic illustration similar to FIG. 3, showing the openings in the casing and penetrations into the surrounding formation following the firing of the gun, with the perforating gun assembly being withdrawn upwardly through the production tubing.

Referring to FIG. 5, is the perforating gun assembly 200 is shown after separation from the landing base assembly 100 as it is withdrawn by the coiled tubing 40 into the production tubing 24. Upon reaching the surface, the shaped charges can be replaced, or the original gun can be removed and replaced with a previously prepared and loaded gun of the same configuration in order to expedite the overall operation. The gun assembly is returned for engagement with the landing base assembly as was previously described. As also shown in FIG. 5, the firing of the perforating gun forms openings in the well liner 22 and penetrated an initial distance "d1" into the reservoir interval 4.

Figure 6:
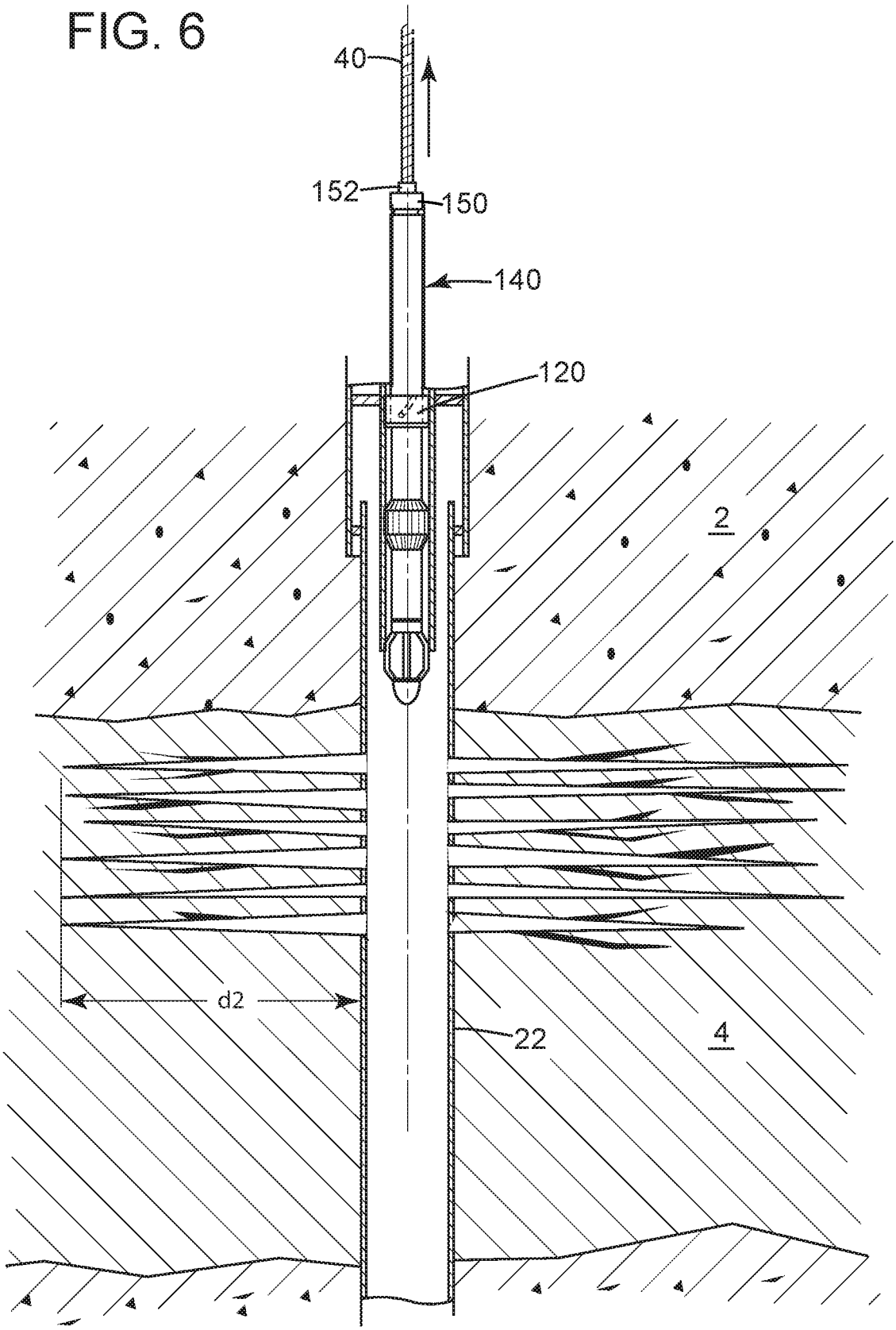
FIG. 6 schematically illustrates the perforating gun assembly and the collapsed landing base assembly being withdrawn through the production tubing following completion of the penetration.

Referring now to FIG. 6, after the second or subsequent and final firing of the perforating gun, the retrievable bridge plug is again actuated to retract both the central sealing section 116 and the supporting legs 114, thereby returning the bridge plug to its original compact generally cylindrical form. The effect of the second firing is shown in FIG. 6 with the extension of the plurality of laterally-extending perforations 14 and the tubing 40 with attached perforating gun assembly and the landing base assembly being withdrawn to the surface leaving the wellbore free of penetration apparatus in preparation for the next step, e.g., hydraulic fracturing.

From the above description and the attached illustrations, it will be understood that after the second firing, the gun can be reloaded or replaced with a fresh loaded gun and returned with the gun assembly for engagement with the landing base assembly for a third firing to effect even deeper penetrations at the same location in the interval 4. The selection of shaped charges for the second and any subsequent firings of the gun 140 in order to produce the depth and diameter of the penetrations 14 in specific types of reservoir rock is within the skill of the art.

Figure 7A:
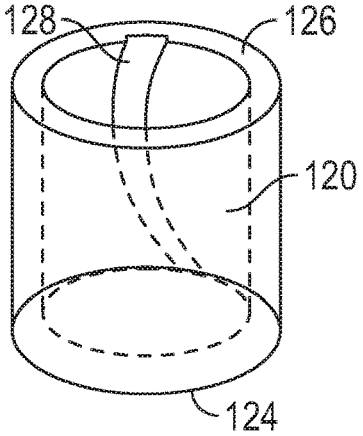
FIG. 7A is a simplified top front perspective view of an embodiment of a receiving member having hollow body with a spiral groove formed in the interior wall for use in the invention.
Figure 7B:
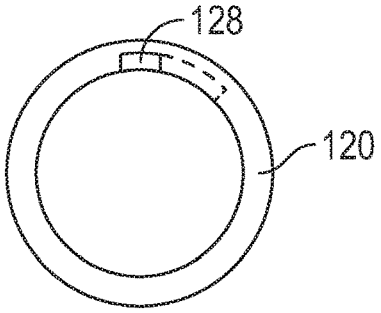
FIG. 7B is a top view of the receiving member of FIG. 7A.

Referring now to FIGS. 7A and 7B, an embodiment of a receiving member 120 suitable for use in the invention is illustrated and will be described in more detail. As shown, the receiving member is a cylindrical hollow body having a solid base plate 124 and rim 126. A guide channel or groove 122 is formed in the interior annular portion of the side wall. As illustrated, the channel 122 assumes a descending spiral path extending from the top rim along the interior circumference towards the base plate 124. As shown in the top view of FIG. 7B, the channel 122 extends to the rim. The upper rim 126 is also provided with a further grooved portion that serves to direct the guide member 130 into the proper orientation and directs the projecting guide pin 132 into the guide channel 122. As previously explained, the guide pin 132 projects from the rotatable guide member which rotates until the pin 132 enters the guide groove 122. Once the downhole end of the guide member has entered the annular space of receiving member 120, the pin 132 will enter the channel 122 and under the force of gravity the two members will become fully mated and locked in releasable engagement.

Figure 9:
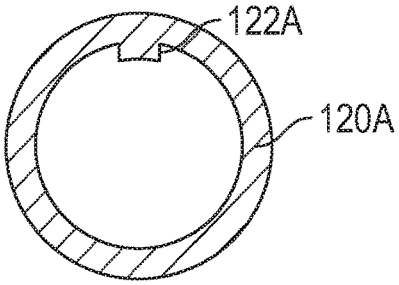
FIG. 9 is a top view of an alternative embodiment of a receiving member having a hollow body and an internally projecting pin for use in the invention.
Figure 10A:
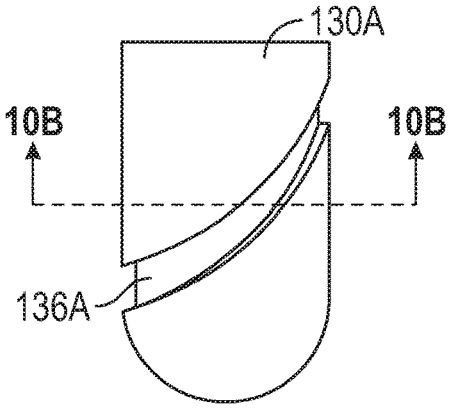
FIG. 10A is a side elevation view of an alternative embodiment of a guide member having a single spiral groove extending longitudinally in its exterior surface that is dimensioned and configured to engage the projecting pin, and to mate with the receiving member of FIG. 9.
Figure 10B:
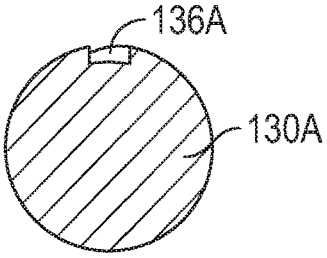
FIG. 10B is a cross-sectional view of the guide member of FIG. 10A taken along section line 10B-10B.

An alternative embodiment for accomplishing the rotational mating engagement is illustrated in FIGS. 9, 10A and 10B where the hollow receiving member 120A is provided with a guide pin 122A projecting from the surface of its interior wall into the annular space and the guide member 130A is provided with a spiral channel or groove 136A in its exterior surface that is configured and dimensioned to receive the guide pin 122A and pass the pin in sliding relation. It will be understood that the mating, rotational movement of the guide member and terminal position of these members is similar to that described above.

Figure 8A:
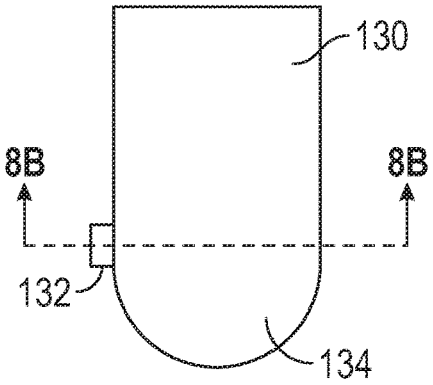
FIG. 8A is a simplified elevation view of a guide member having a radially projecting guide pin that is dimensioned and configured to slidably engage the spiral groove in the receiving member of FIGS. 7A and 7B.
Figure 8B:
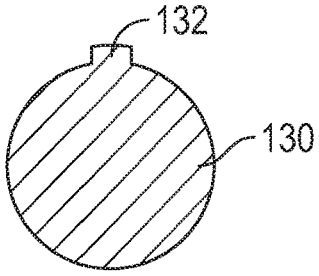
FIG. 8B is a cross-sectional view of the guide member of FIG. 8A taken along section line 8B-8B.

As shown in both FIGS. 8A and 10A, the downhole end of the respective guide members 130, 130A are rounded to facilitate their axial alignment with the hollow receiving members 120, 120A, and engagement in mating relation.

As will be apparent to one of ordinary skill in the art, other shapes, e.g., conical, pyramidal, and combinations, can be employed to facilitate the initial alignment and any rotation needed to pass the pin into the groove.

Figure 11:
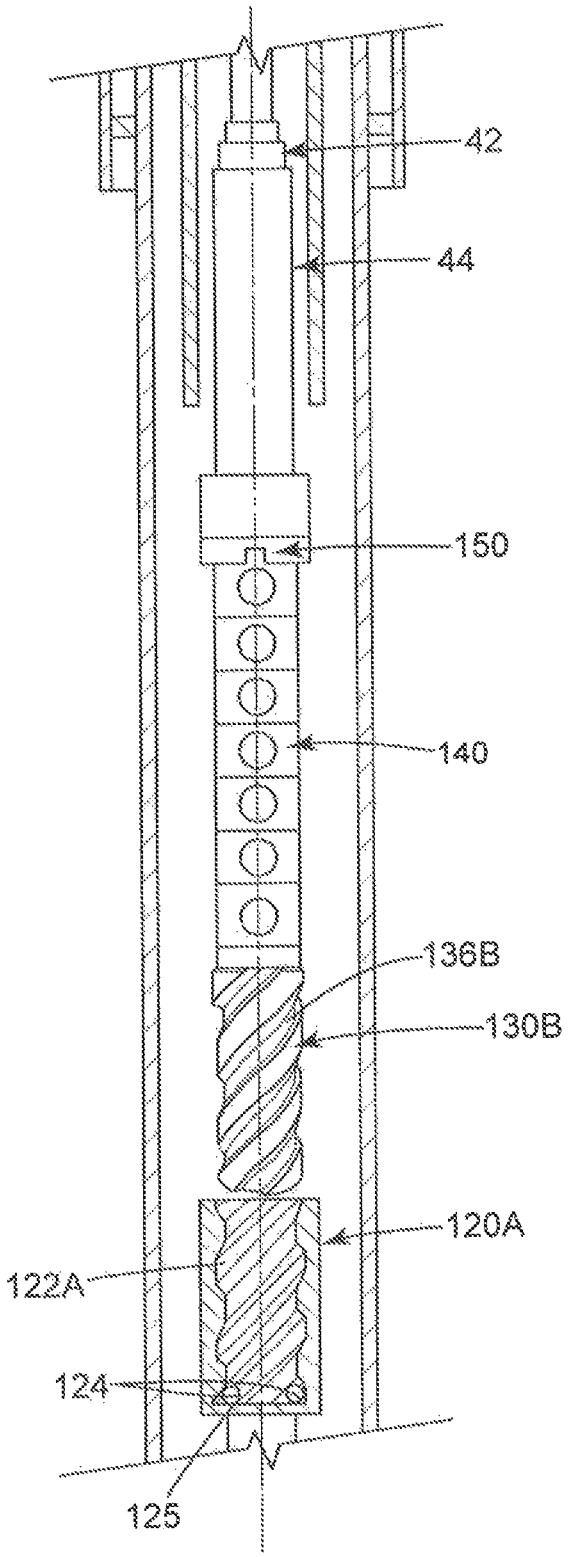
FIG. 11 is a simplified schematic side elevation of another embodiment of a guide member forming part of a perforating gun assembly positioned above a hollow receiving member that is shown in section.

Referring now to the embodiment of FIG. 11, the perforating gun assembly is shown fitted with a guide member 130B of an alternative configuration that can be similar to that of a drill bit or other precision, low friction threaded device having multiple spiral grooves or channels 136B and a tapered land or projecting surface. The hollow receiving member 120A is configured with mating spiral grooves 122A for receiving the guide member 130B. The grooves and lands of both the receiving member 120 and guide member 130B have smooth and preferably polished surfaces to facilitate the sliding engagement with, and passage of the lands and grooves 122A and 136B in the respective members. The threaded portions of one or both of the guide and receiving members can be constructed from a carbide steel or other alloy having a high impact strength to withstand the initial impact of the guide member with the stationary receiving member and the frictional forces during withdrawal of the gun assembly. The surface of the respective members can also be treated and/or coated to reduce friction and provide durability and wear resistance under the severe conditions present in the well bore.

The respective male and female threads are machined to a very smooth and preferably a polished finish to facilitate their respective rotational movement after engagement. Upon engagement of the free end of the guide member with the open end of the receiving member, the downward force causes the guide member and the elements above it to rotate, e.g., in a clockwise direction by virtue of at the rotating head member 150 attached to the stationary locking device 152 on top of the gun assembly to advance the guide member into the receiving member. Similarly, disengagement is initiated by an upward force which causes the guide member and the gun assembly above it to rotate in a counterclockwise direction to withdraw the guide member.

In accordance with an embodiment as illustrated in FIG. 11, the perforating gun assembly is also provided with a supplemental weight member 44 that is mounted in axial alignment with the perforating gun 140 and serves to provide an additional vertical force to ensure the downward rotational movement and seating of the guide member against the interior bottom surface 125 of the receiving member 120A.

If the initial contact between the guide and receiving members does not result in the desired rotational engagement, the assembly is withdrawn via the coiled tubing 40 and then lowered, repeatedly if necessary, until the members engage for relative rotational movement and entry of the guide member 130B into the receiving member 12A. As will be understood by one of ordinary skill in the art, because of the nature of coiled tubing, following each attempt there will be a change in the radial orientation of the guide member.

As will be understood by one of ordinary skill in the art, the contact surfaces of the grooves or channels in the respective members as well as the interior and exterior surfaces of the receiving and guide member can be contaminated with drill mud and debris so that fit tolerances between the various moving elements must take into account the environmental conditions and the nature of the contaminants. Thus, the actual weight of the supplemental weight member 44 will be determined by taking these environmental factors into account. This problem can also be reduced by flushing the section of the wellbore to remove contaminants to the extent practically possible. Also as shown in FIG. 11, the bottom portion of the hollow receiving member 120A is provided with drain holes to permit the escape of liquids and any solids that must be displaced by the guide member entering the hollow body and thereby facilitating the movement of the guide member.

Other configurations for the receiving member and guide member will be apparent to those of ordinary skill in the art and can be adapted for the secure mating of these two elements.

It will be understood from this description that the two elements undergo a relative axial rotational movement upon initial engagement which is the result of gravitational forces and the weight or mass of the gun assembly and, optionally, the supplemental weight member 44. This relative rotational movement can be facilitated by providing the engagement surfaces with a highly-polished finish, with a coating or layer of low friction materials, ball or roller bearings, and the like. Releasable locking devices such as a spring-biased ball and corresponding detent can be provided.

The size of the wellbore drilled in tight gas reservoir rock depends upon the overall well design descending from the surface to the reservoir target zone. In some wells, the target zone is drilled with an 8⅜" hole: in other wells, the target zone is drilled with a 5⅞" hole. The 8⅜" hole is cased with 7" pipe liner. The 5⅞" hole is cased with a 4½ liner. In an open hole, or OH completion. The hole drilled in the target zone is left open without a cemented pipe liner. In a closed hole, or CH completion, the target zone is provided with a cemented pipe liner. The liner extends from the bottom of the OH to +/−300 feet inside the casing above the open hole. The casing extends to the earth's surface. The design of the well will take into consideration the size and positioning of the various tools and fittings required in the practice of the invention as described.

From the above description, it will be understood that the method and apparatus of the present invention overcomes tight formation productivity problems because the same interval can be perforated two or more times to create the larger and deeper holes needed to reach the virgin portion of the reservoir for higher well productivity and/or well injectivity. Additionally, the method facilitates stimulation treatments in especially tight formations of high compressive strength where achieving deep perforation penetration is particularly difficult.

The use of the retrievable bridge plug also permits all of the elements of the system to be withdrawn from the site of the perforations, thereby simplifying the subsequent hydrofracturing operations and the eventual well completion, including the need to drill out the bridge plug. Importantly, the use of the retrievable bridge plug permits the penetration plan to include accurate penetrations at one or more additional intervals at locations downhole of the first interval because the positioning of the elements of the apparatus is entirely within the control of the well engineer and is not hampered by previously installed apparatus that is still in position. The use of the retrievable bridge plug permits the method to be practiced in any of a variety of diameters of lines and casings, as well as in open hole completions.

It will also be understood from the preceding description that the relative positions of the receiving member and guide member can be reversed. Thus, the hollow receiving member can be mounted on the downhole end of the perforating gun and the guide member secured to the upper surface of the bridge plug. The same relative rotational movement is achieved in this configuration as the downwardly facing open end of the receiving member descends into engagement with the guide member under the force of gravity.

The method and apparatus of this disclosure thus provides improvements for the more efficient repeated perforation of tight rock formations in preparation for the subsequent hydraulic fracturing treatments.

Although the apparatus and method have been described in detail above and illustrated in the drawings, modifications and variations from this description will be apparent to those of ordinary skill in the art, and the scope of protection for the invention is to be determined by the claims that follow.

The invention claimed is:

1. An apparatus for sequentially penetrating at the same location a predetermined interval (4) of a tight reservoir rock formation (2) adjacent a wellbore (10), the wellbore provided with a liner or casing spanning the interval, the apparatus including a perforating gun (140) containing a plurality of shaped charges (144), the apparatus characterized by:

a. a landing base assembly comprising:

(i) a retrievable bridge plug (110) having a central axis secured at a predetermined position in the liner or casing, and (ii) an annular receiving member (120) having a bottom wall (124) secured in stationary axial alignment to the upper end of the bridge plug, the interior side wall of the stationary annular receiving member (120) configured with at least one descending spiral guide channel (128) of predetermined width, the guide channel terminating proximate the interior surface of the bottom wall (12), the receiving member dimensioned and configured to receive a guide member (130) in a secure mating relationship by relative rotational movement of the guide member in the at least one spiral guide channel; and b. a perforating gun assembly comprising:

(i) the perforating gun (140), (ii) the guide member (130) secured to the downhole end of the perforating gun (140) and dimensioned and configured to securely mate with the annular receiving member (120) and to slidably engage the guide channel (128) of the receiving member in relative rotational movement terminating in a final secured interlocking position relative to the guide channel with the downhole end of the guide member in contact with the interior of the bottom wall (124) of the receiving member; and (iii) a supplemental weight member (44) secured to the upper end of the perforating gun (140); and c. a rotating head member (150) secured at its downhole end to the upper end of the supplemental weight member (44) and having an attachment mechanism (122) at its upper end configured to engage a stationary locking member (152) attached to the downhole end of a length of coiled tubing (40), the rotating head member (150) operable to permit axial rotation of the gun (140) and guide member (130) relative to the coiled tubing (105) and the stationary receiving member.

2. The apparatus of claim 1 in which the receiving member and guide member are generally cylindrical.

3. The apparatus of claim 2 in which the surface of the guide member is formed with at least one spiral groove having a defined pitch and depth and the receiving member defines an annular opening, the wall of which has one or more radially projecting elements dimensioned and configured to engage the at least one spiral groove of the guide member and impart rotational movement to the guide member as the guide member enters the receiving member until the guide member contacts the bottom wall of the receiving member in a final fixed position.

4. The apparatus of claim 1 in which the surface of the guide channel (122) or the guide member (130), or the surfaces of both, are treated to minimize friction and thereby facilitate a downward spiral movement of the guide member relative to the receiving member (120).

5. The apparatus of claim 4 in which the guide member has one projecting guide pin and the receiving member has a channel formed in its annular interior wall, whereby the perforating gun assembly rotates as the guide member moves vertically relative to the receiving member.

6. The apparatus of claim 5 in which the guide member enters an axial opening formed in the receiving member.

7. The apparatus of claim 1 in which the retrievable bridge plug has radially extendible arms that terminate in surfaces which are configured and dimensioned to securely engage the adjacent interior surface of a section of the wellbore or, optionally, the adjacent well liner or casing to thereby resist vertical displacement of the apparatus.

8. A method of sequentially performing a plurality of same location perforations in a predetermined interval of a wellbore in a tight reservoir rock formation in order to penetrate deeply into the rock, the method comprising:

a. providing a landing base assembly that includes an expandable bridge plug having a central axis and an annular receiving member having a bottom wall secured in stationary axial alignment to the upper end of the bridge plug;

b. lowering the landing base assembly through a length of production tubing to a predetermined position that is below and proximate the interval to be penetrated;

c. actuating the bridge plug to extend integral contact surfaces to the wall of the wellbore, a well liner or casing that is adjacent the bridge plug to secure the bridge plug in a fixed position that resists vertical displacement in the wellbore;

d. providing a perforating gun assembly that includes (i) a perforating gun (140), (ii) a rotating head member (150) secured at its downhole end to the upper end of the perforating gun (140) and having an attachment mechanism at its upper end configured to engage a stationary locking member (152) attached to the downhole end of a length of coiled tubing, the rotating head member operable to permit axial rotation of the gun and guide member relative to the coiled tubing (105) and stationary locking member, and (iii) a guide member secured to the downhole end of the gun, the guide member dimensioned and configured to securely mate with the receiving member;

e. lowering the perforating gun assembly via the coiled tubing to engage the guide member with the receiving member and to advance the guide member in a downhole direction with rotational movement relative to the stationary receiving member and into a final securely mated engagement in which the lower end portion of the guide member is in direct contact with the interior surface of the bottom wall of the receiving member;

f. firing a first series of charges from the gun to penetrate the reservoir rock along the interval with a first series of openings;

g. applying an upward force on the gun assembly via the coiled tubing to disengage it from the fixed landing base assembly by withdrawing the guide member with rotational movement relative to the stationary receiving member;

h. retrieving the gun assembly from the wellbore, reloading the gun or installing a new gun with fresh charges and returning the gun assembly to a securely engaged position with the landing base assembly in accordance with step (e) above; and i. firing a second series of charges from the gun into the formation at the same locations as the first series of charges to provide openings penetrating deeper into the formation than the first series of openings.

9. The method of claim 8 which includes providing a separate supplemental weight member (44) above the perforating gun assembly to facilitate the downward rotational mating movement of the guide member relative to the stationary receiving member.

10. The method of claim 9 in which the supplemental weight member (44) is secured in axial alignment to the rotating head member (150).

11. An apparatus for penetrating a predetermined interval (4) of a tight reservoir rock formation (2) adjacent a wellbore (10), the wellbore optionally provided with a liner or casing spanning the interval, the apparatus including a perforating gun (140) containing a plurality of shaped charges (144), the apparatus characterized by:

a. a landing base assembly comprising:

(i) a retrievable bridge plug (110) having a central axis secured at a predetermined position in the liner or casing, and (ii) an annular receiving member (120A) having a bottom wall (124) secured in stationary axial alignment to the upper end of the bridge plug, the interior side wall of the annular receiving member (120A) configured with at least one radially projecting guide element (122A), the annular receiving member dimensioned and configured to receive a guide member (130A) in a secure mating relationship by relative rotational movement of the guide member (130A) with respect to the guide element (122A);

b. a perforating gun assembly comprising:

(i) the perforating gun (140), (ii) the guide member (130A) secured to the downhole end of the perforating gun (140), the guide member having a generally cylindrical body with a tapering downhole end portion, provided with at least one spiral guide channel (136A) extending upwardly from the tapering downhole end portion, the guide member (130A) dimensioned and configured to enter and securely mate with the annular receiving member (120A) and to slidably engage the guide element (122A) of the receiving member in relative rotational movement terminating in a final secured interlocking position relative to the guide element and in contact with the interior of the bottom wall (124) of the annular receiving member;

(iii) a supplemental weight member (44) secured to the upper end of the perforating gun (140); and c. a rotating head member (150) secured at its downhole end to the upper end of the supplemental weight member (44) and having an attachment mechanism (122) at its upper end configured to engage a stationary locking member (152) attached to the downhole end of a length of coiled tubing (40), the rotating head member (150) operable to permit axial rotation of the gun (140) and guide member (130A) relative to the coiled tubing (105) and the stationary annular receiving member.

* * * * *